United States Patent [19]

Shinkawa

[11] Patent Number: 4,829,317

[45] Date of Patent: May 9, 1989

[54] MOTOR DRIVEN ANTENNA FOR VEHICLES

[75] Inventor: Masami Shinkawa, Yamato, Japan

[73] Assignee: Harada Kogyo Kabushiki Kaisha, Tokyo, Japan

[21] Appl. No.: 80,323

[22] Filed: Jul. 31, 1987

[30] Foreign Application Priority Data

Sep. 5, 1986 [JP] Japan ..... 61-136507

[51] Int. Cl.[4] ..... H01Q 1/10

[52] U.S. Cl. ..... 343/903; 343/901

[58] Field of Search ..... 343/903, 901, 900, 715

[56] References Cited

U.S. PATENT DOCUMENTS

| | | | |
|---|---|---|---|
| 2,677,973 | 5/1954 | Gosline | 343/903 |
| 2,870,973 | 1/1959 | Carlson | 343/903 |
| 3,146,450 | 8/1964 | Dooner | 343/903 |
| 3,253,799 | 5/1966 | Till | 343/903 |
| 4,323,902 | 4/1982 | Hussey et al. | 343/903 |
| 4,591,868 | 5/1986 | Cusey et al. | 343/903 |

*Primary Examiner*—William L. Sikes

*Assistant Examiner*—Robert E. Wise

*Attorney, Agent, or Firm*—Koda and Androlia

[57] ABSTRACT

A motor driven antenna for vehicles including an antenna element, an antenna housing tube which stores the antenna element and is fixed to a mounting hole of the vehicle body, a motor mechanism mounted on the base of the antenna housing tube, which retracts and extends the antenna element housed in the antenna housing tube, and a coupling mechanism for coupling the casing for the motor mechanism to the antenna housing tube. The coupling mechanism includes a first vibration absorber provided between a housing tube holding section of the motor mechanism casing and the base portion of the antenna housing tube, a second vibration absorber which fits on the antenna housing tube at a position away from the first vibration absorber a specified distance toward the tip of the end of the antenna housing tube and a coupling member for connecting the second vibration absorber and the motor mechanism casing so that the coupling member holds the second vibration absorber therein.

2 Claims, 3 Drawing Sheets

MOTOR DRIVEN ANTENNA FOR VEHICLES

BACKGROUND OF THE INVENTION

1. Field of the Invention

The present invention relates to a motor driven antenna for vehicles, such as automobiles, etc. which prevents vibrations originating from the motor mechanism thereof from being transmitted to the vehicle body.

2. Prior Art

Generally, conventional motor driven antennas of this type have an extendible antenna element in a stick form stored in an antenna housing tube. The top end portion of the antenna housing tube has an inlet/outlet opening for the antenna element and is fixed to a fitting hole on the body of the vehicle. A motor mechanism for extending and retracting the antenna element is mounted on the base of the antenna housing tube. A motor mechanism casing and the antenna housing tube are usually connected to each other by directly fitting the base end of the antenna housing tube to a housing tube holding portion of the motor mechanism casing, and then fixing them to each other with fastening means such as screws, etc.

The conventional motor driven antennas described above, however, have problems such as when the motor mechanism is actuated to extend and retract the antenna, vibrations caused by rotation of the motor as well as rotation of a rotary drum in the motor mechanism, vibrations caused by sliding of the antenna driving wire and vibrations which occur due to the impact caused during extension and retraction of the antenna element, etc. are transmitted to the vehicle body through the antenna housing tube. As a result, very loud noises are generated due to the resonance phenomena caused by the vibrations. Such noise is extremely unpleasant to the user and an improvement to reduce the noise has been strongly desired. In order to prevent such noise, several devices have been devised.

In one such means the end portion of the antenna housing tube is fitted to the vehicle body using a vibration absorbing member provided between them. However, since the vibration absorbing member is provided where the antenna is firmly fixed to the vehicle body, it is difficult to allow the vibration absorbing member to be sufficiently thick so that it can function properly. Accordingly, the vibrations cannot be sufficiently absorbed.

Another device designed to reduce vibration of the motor mechanism uses a vibration absorbing member placed between the motor mechanism and a mounting bracket. This device, however, is defective because although vibration of the motor mechanism is reduced, vibrations caused due to sliding of the wire, etc. cannot be sufficiently absorbed, and the remaining constituent vibration is transmitted to the vehicle body through the antenna housing tube. Thus, it is impossible to obtain advantageous results.

In another device vibration of the motor mechanism is prevented from being transmitted to the vehicle body by connecting the middle portion of the antenna housing tube with rubber tubes, etc. Although the desired result can be obtained to a certain extent with this device since the middle part of the antenna housing tube is connected with rubber tubes, etc., which are elastic members, the antenna housing tube cannot be held securely, and lateral shake of "<" shape occurs in the antenna housing tube due to vibration of the vehicle body, etc.

SUMMARY OF THE INVENTION

Therefore, the object of this invention is to provide a motor driven antenna for vehicles wherein vibrations generated from the motor mechanism, etc. are sufficiently prevented from being transmitted to the vehicle body, thus preventing noise from being generated.

Another object of this invention is to provide a motor driven antenna for vehicles which does not cause any lateral shake, etc. of the antenna housing tube.

The above objects are achieved by a unique antenna structure including a coupling mechanism which connects the motor mechanism casing to the antenna housing tube. The coupling mechanism includes first and second vibration absorbers and a coupling member. The first vibration absorber is inserted between an antenna housing tube holding section of the motor mechanism casing and the base of the antenna housing tube, the second vibration absorber is fitted the antenna housing tube a specified distance away from the first vibration absorber toward the top end of the antenna housing tube, and the coupling member connects the second vibration absorber and the motor mechanism casing such that the coupling member holds the second vibration absorber therein.

Since the first vibration absorber is interposed between the antenna housing tube holding section of the motor mechanism casing and the base portion of the antenna housing tube, vibrations from the motor mechanism are absorbed by the first vibration absorber. As a result, transmission of vibrations to the vehicle body through the antenna housing tube can be sufficiently restrained. Also, since the base portion of the antenna housing tube is supported elastically by the first vibration absorber, vibrations caused by sliding of the wire as well as vibrations caused by the impact which occurs during extension and retraction of the antenna element can be abated. Consequently, transmission of the vibratins to the vehicle body through the antenna housing tube can be inhibited. In addition, except for the base, the antenna housing tube is supported by the motor mechanism casing through the second vibration absorber; therefore, lateral shaking (rolling), etc. caused by vibration of the vehicle body, etc. is prevented.

DETAILED DESCRIPTION OF THE INVENTION

Figure 1:
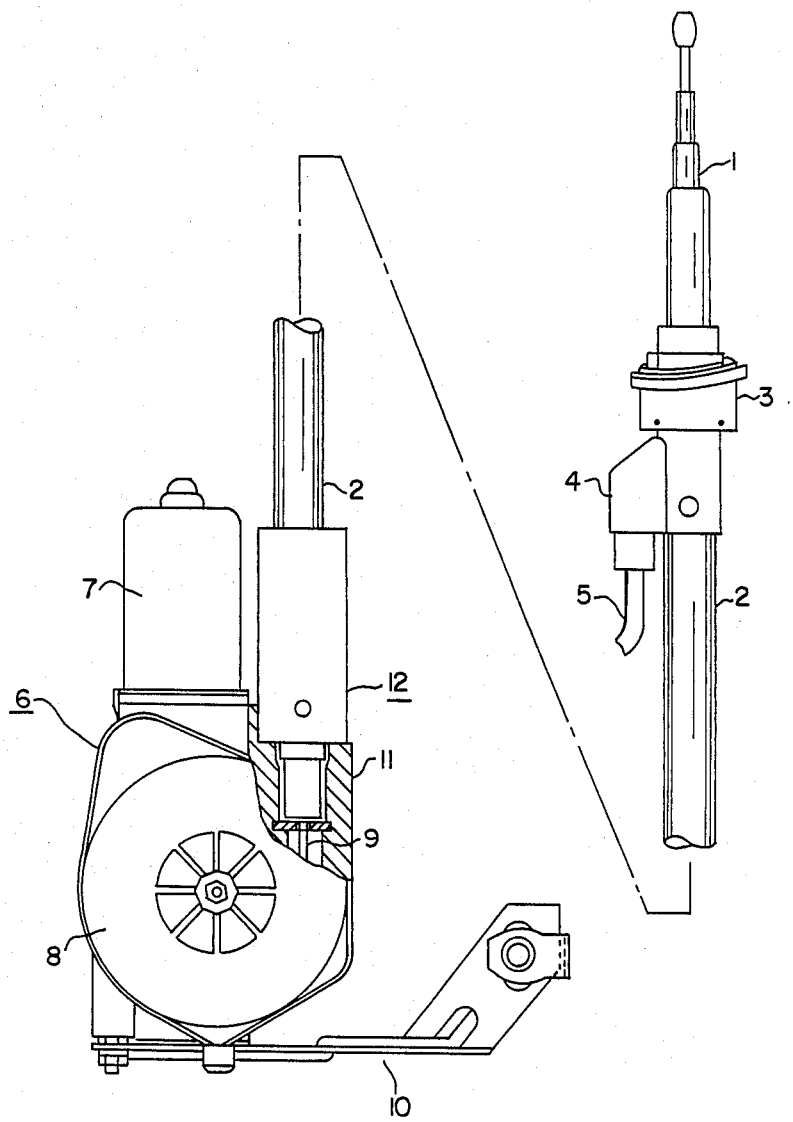
FIG. 1 is a side view showing the overall appearance of the motor driven antenna of the invention.

FIG. 1 is a side view showing an embodiment according to this invention.

The reference numeral 1 is a multistage telescopic antenna element and a plurality of conductive pipes of respectively different diameters are connected so as to be freely slidable against each other. This antenna element 1 is housed in an antenna housing tube 2 so that it can be optionally moved in and out of the antenna housing tube 2. One end of the antenna housing tube 2 which has an inlet/outlet opening for the antenna element 1 is fixed into a mounting hole (not shown in the Figure) of a vehicle body with a mounting mechanism 3. Adjacent the mounting mechanism 3, an antenna power supply section 4 is provided so that it is connected to a transmitter/receiver (not shown in Figure) through a feeder line 5.

At the base portion of the antenna housing tube 2, a motor mechanism 6 is disposed. In this motor mechanism 6 a rotary drum 8 is rotated by the driving force of the motor 7 to wind and unwind a flexible wire 9. Thus, the motor mechanism 6 retracts the antenna element 1 into the antenna housing tube 2 and extends the antenna element 1 out from the antenna housing tube 2.

A mounting bracket 10 fixes the motor mechanism 6 to the vehicle body wall (not shown in the Figure).

The base of the antenna housing tube 2 and a housing tube holding section 11 of the casing for the motor mechanism 6 are coupled by means of a cupling mechanism 12.

Figure 2:
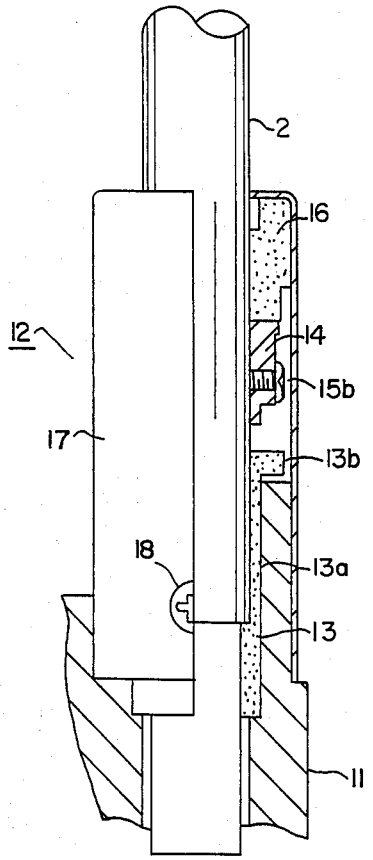
FIG. 2 is a partially cut-away side view showing the structure of a coupling section which is an essential part of the antenna.
Figure 3:
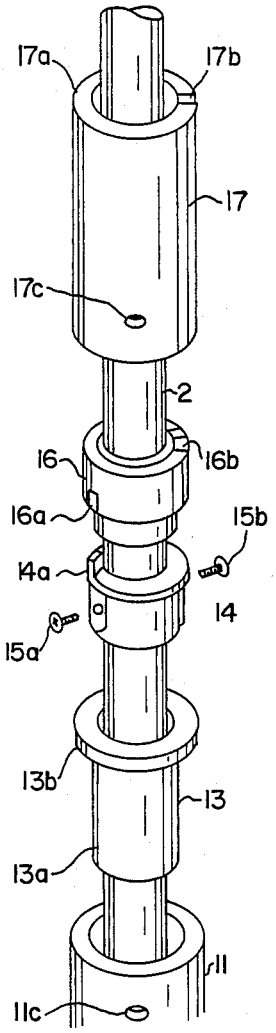
FIG. 3 is an exploded perspective view of the coupling section.

FIG. 2 is a side view showing a part of the coupling mechanism 12 by cutting it away partially, and FIG. 3 is a persective view showing the coupling mechanism disassembled.

In FIGS. 2 and 3, the reference numeral 13 is a first vibration absorber formed of, for example, a spongy foamed material. This absorber 13 has a cylindrical portion 13*a* of, for example, 40 mm in total length and about 2.5 mm in thickness and a flange portion 13*b*. The first vibration absorber 13 is disposed between the housing tube holding section 11, which is a part of the casing for the motor mechanism 6, and the antenna housing tube 2.

A stopper 14 fastened to the outer circumference of the antenna housing 2 by screws 15*a* and 15*b* prevents slipping.

Reference numeral 16 denotes a second vibration absorber formed of material equal in quality, but a little harder than the material of the first vibration absorber 13. The second vibration absorber 16 is disposed on the stopper 14. In other words, the second vibration absorber 16 fits over the antenna housing tube 2 at a position away from the first vibration absorber 13 at a specified distance toward the upper end of the antenna housing tube 2.

A caved portion 16*a* provided in a part of the second vibration absorber 16 is designed to engage with projection 14*a* of the stopper 14.

Reference numeral 17 denotes a coupling tube which is made, for example, of aluminum (A1) and has an open lower end. This coupling tube 17 covers the second vibration absorber 16, the stopper 14 and the first vibration absorber 13 from outside. A flange portion 17*a* formed at the upper end of the coupling tube 17 comes into a press-contact with the upper end of the second vibration absorber 16, while the inner circumferential surface of the coupling tube 17 comes into close contact with the outer circumferential surface of the second vibration absorber 16. A cutout portion 17*b* formed in the flange portion 17*a* is engaged with a projection 16*b* of the second vibration absorber 16.

The second vibration absorber 16 is coupled with the housing tube holding section 11 by inserting a screw 18 to a hole 17*c* of the circumferential wall of the coupling tube 17, then by screwing the screw 18 into a tapped hole 11*c* formed in the circumferential wall of the housing tube holding section 11.

Furthermore, with the engagement between the projection 14*a* and the caved portion 16*a*, as well as the engagement between the projection 16*b* and the cutout portion 17*b*, the position in the circumferential direction of the antenna housing 2, the stopper 14, the second vibration absorber 16 and the coupling tube 17 can be specified. Therefore, by fixing the coupling tube 17 to the housing tube holding section 11 with the screw 18, the circumferential direction of the antenna housing tube 2 is set, as a natural consequence, to the desired direction. When it is desired to change this direction, it can be done by changing the fixing angle of the stopper 14 against the antenna housing tube 2.

In the above described embodiment, vibration of the motor mechanism 6, which is caused during extension and/or retraction of the antenna element 1, is sufficiently absorbed by the first vibration absorber 13. Accordingly, transmission of vibrations to the vehicle body via the antenna housing tube 2 can be prevented satisfactorily.

Also, since the base end portion of the antenna housing tube 2 is supported elastically by the first vibration absorber 13, vibrations generated due to the sliding of the wire 9 as well as vibrations caused by the impact created during extension and retraction of the antenna element 1 can be moderated.

As a result, the above described vibrations can be suppressed and are not transmitted to the vehicle body through the antenna housing tube 2. Besides, the antenna housing tube 2, except for the base end portion thereof, is supported by the housing tube holding section 11 of the casing for the motor mechanism 6 by means of the second vibration absorber 16 and the coupling tube 17, the antenna housing tube 2 is held securely. Thus, rolling of the antenna housing 2 caused by vibration of the vehicle body, etc. can be prevented.

Figure 4A:
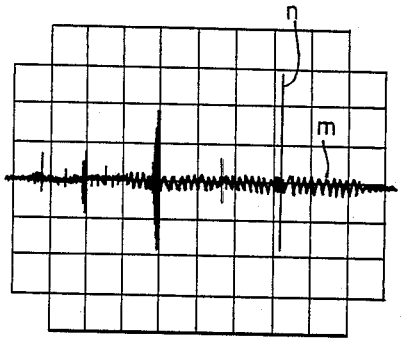
FIGS. 4(*a*) and 4(*b*) show the vibrations which occur during the extending operation of the antenna element of this invention compared to a conventional antenna.
Figure 4B:
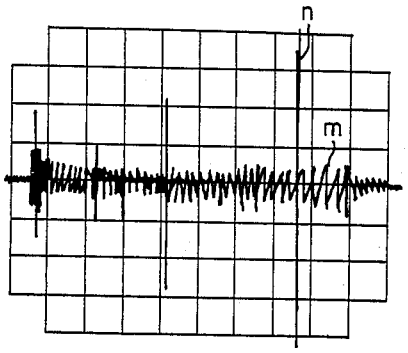

FIGS. 4(*a*) and 4(*b*) show the results of an oscilloscopic recording of vibrations which occur in the antenna housing 2 during the extending operation of the antenna element when the tube is mounted to the vehicle body. Specifically, FIG. 4(*a*) shows the results obtained with an embodiment of the present invention, and FIG. 4(*b*) shows the results obtained with a conventional antennna not having a vibration absorbing means.

Figure 5A:
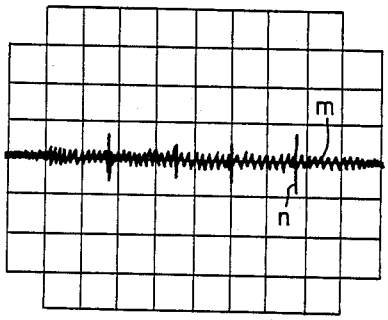
FIGS. 5(*a*) and 5(*b*) show the vibrations which occur during the retracting operation of the antenna element of this invention compared to a conventional antenna.
Figure 5B:
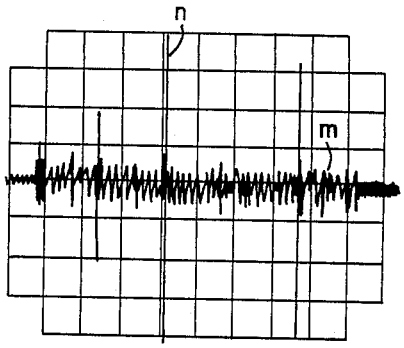

FIGS. 5(*a*) and 5(*b*) show the results of an oscilloscopic recording of vibrations which occur at the portion of the vehicle body where the antenna housing 2 is mounted during retraction of the antenna element. Specifically, FIG. 5(*a*) shows the results obtained with an embodiment of the present invention and FIG. 5(*b*) shows the results obtained with a conventional antenna not having vibration absorbing means.

In FIGS. 4(*a*), 4(*b*), 5(*a*) and 5(*b*), m represents vibrations created by the motor 6 and n indicates shock vibrations which occur intermittently when the conductive pipes which comprise the antenna element 1 move during extension or retraction thereof.

As should be apparent from these Figures, vibrations from the motor 6 are reduced to about one third to one fourth of that in the conventional example, and also, vibrations accompanying the impact among the conductive pipes during extension or retraction thereof can be substantially reduced.

The present invention is not limited to the above described embodiment. For example, in the foregoing embodiment, the coupling tube 17 is provided as the coupling member. The coupling member does not necessarily have to cylindrical in shape, but may be an L-shaped or ]-shaped member. Furthermore, although the present invention applies to a type of antenna wherein the vibration absorber is not inserted in a section of the mounting mechanism 3, the present invention may be applied to such antenna. In addition, various modifications may be made within the true spirit and scope of the invention.

In the present invention, the mechanism which couples the motor mechanism casing to the antenna housing tube includes: (a) a first vibration absorber interposed between the housing tube holding section of the motor mechanism casing and the base end of the antenna housing tube, (b) a second vibration absorber which fits on the antenna housing tube and is positioned at a specified position toward the upper end of the antenna housing tube away from the first vibration absorber, and (c) a coupling member for connecting the second vibration absorber to the motor mechanism casing so as to hold the second vibration absorber therein. Consequently, the motor driven antenna of the present invention blocks vibrations from the electric motor which would be transmitted to the vehicle body, and prevents noise, lateral shaking, etc. from being transmitted to the antenna housing tube.

I claim:

1. A motor driven antenna for vehicles comprising:

an antenna element;

an antenna housing tube for storing said antenna element so that said antenna element is freely extendible and retractable, said antenna housing tube being fixed to a mounting hole on the vehicle body with an end portion of said antenna housing tube having an inlet/outlet opening for said antenna element;

a motor mechanism including a casing for said motor mechanism provided at the base of said antenna housing tube, said motor mechanism drawing said antenna element into said antenna housing tube and pushing said antenna element out of said antenna housing tube; and a coupling mechanism for coupling the casing for said motor mechanism to said antenna housing tube, said coupling mechanism including:

a first vibration absorber provided between an antenna housing tube holding section of said casing for said motor mechanism and the lower end of said antenna housing tube;

a second vibration absorber which fits on said antenna housing tube at a position away from said first vibration absorber a specified distance toward the upper end of said antenna housing tube; and a cylindrical coupling member provided coaxially with said antenna housing tube and coupled at a lower end thereof to said casing for said motor mechanism, said cylindrical coupling member surrounding and engaging with said second vibration absorber so that said cylindrical coupling member holds said second vibration absorber.

2. A motor driven antenna for vehicles according to claim 1, wherein said first vibration absorber is made from a spongy foam material and said second vibration absorber is made from a material which is harder than the material from which said first vibration absorber is made.

* * * * *